US012557915B2

(12) United States Patent
Zhang et al.

(10) Patent No.: US 12,557,915 B2
(45) Date of Patent: Feb. 24, 2026

(54) AIR MATTRESS

(71) Applicant: Foshan Tiansheng Leisure Sports Goods Co., LTD, Foshan (CN)

(72) Inventors: Guoming Zhang, Foshan (CN); Weiming Wu, Foshan (CN); Zhigan Liang, Foshan (CN); Jiaqian Luo, Foshan (CN); Shujun Liang, Foshan (CN)

(73) Assignee: FOSHAN TIANSHENG LEISURE SPORTS GOODS CO., LTD, Foshan (CN)

( * ) Notice: Subject to any disclaimer, the term of this patent is extended or adjusted under 35 U.S.C. 154(b) by 111 days.

(21) Appl. No.: 18/528,881

(22) Filed: Dec. 5, 2023

(65) Prior Publication Data

US 2025/0107636 A1 Apr. 3, 2025

(30) Foreign Application Priority Data

Sep. 28, 2023 (CN) ..... 202322669598.0
Nov. 6, 2023 (CN) ..... 202322993048.4

(51) Int. Cl.
*A47C 27/08* (2006.01)

(52) U.S. Cl.
CPC ..... *A47C 27/081* (2013.01); *A47C 27/087* (2013.01)

(58) Field of Classification Search
CPC ..... A47C 27/081; A47C 27/087; A47C 27/08; A47C 27/18; B29D 22/02; B29D 22/00; B29K 2027/06
See application file for complete search history.

(56) References Cited

U.S. PATENT DOCUMENTS 3,251,075 A * 5/1966 Saltness ..... A47G 9/1027 383/3
4,644,597 A * 2/1987 Walker ..... A47C 27/087 5/711
4,788,729 A * 12/1988 Walker ..... A47C 27/082 137/557
7,089,618 B1 * 8/2006 Metzger ..... A47C 27/087 5/709
7,694,372 B1 * 4/2010 Boyd ..... A47C 27/081 5/711
11,503,920 B1 * 11/2022 Shi ..... A47C 27/10
11,969,098 B1 * 4/2024 Shi ..... A47C 27/087
12,053,097 B1 * 8/2024 Luo ..... A47C 27/082
(Continued)

FOREIGN PATENT DOCUMENTS

CN 110432702 A * 11/2019 ..... A47C 27/002

*Primary Examiner* — David E Sosnowski
(74) *Attorney, Agent, or Firm* — Bayramoglu Law Offices LLC

(57) ABSTRACT

An air mattress is provided. The air mattress includes a top sheet, a bottom sheet, and an enclosing sheet, where an air chamber is provided therein with multiple upper diagonal pulling sheets and multiple lower diagonal pulling sheets; ends of each of the upper diagonal pulling sheets are provided with upper curved portions; the upper curved portions are located at an inner side of a corresponding corner and each include a lower edge connected to the inner side of the corner; ends of each of the lower diagonal pulling sheets are provided with lower curved portions; and the lower curved portions are located at an inner side of a corresponding corner and each include an upper edge connected to the inner side of the corner.

9 Claims, 4 Drawing Sheets

(56) References Cited

U.S. PATENT DOCUMENTS

| | | | | |
|---|---|---|---|---|
| 12,102,235 | B1 * | 10/2024 | Luo | A47C 27/087 |
| 12,369,724 | B2 * | 7/2025 | Zhang | B29D 22/02 |
| 2003/0013376 | A1 * | 1/2003 | Larson | G09B 1/02 446/236 |
| 2003/0200610 | A1 * | 10/2003 | Wang | A47C 27/10 5/710 |
| 2004/0232170 | A1 * | 11/2004 | Glick | G09B 19/00 222/383.1 |
| 2006/0265810 | A1 * | 11/2006 | Wu | A47C 27/081 5/712 |
| 2007/0044243 | A1 * | 3/2007 | Metzger | A47C 27/087 5/710 |
| 2011/0247136 | A1 * | 10/2011 | Crucs | A47G 9/0215 5/482 |
| 2013/0318784 | A1 * | 12/2013 | Elliott | G06F 16/20 707/803 |
| 2017/0196368 | A1 * | 7/2017 | Liu | A47C 27/081 |
| 2017/0290445 | A1 * | 10/2017 | Cerri, III | A47D 15/00 |
| 2017/0367541 | A1 * | 12/2017 | Detlor | F16B 47/00 |
| 2021/0127849 | A1 * | 5/2021 | Li | A47C 27/10 |
| 2021/0169232 | A1 * | 6/2021 | Hou | A47C 27/087 |
| 2021/0196053 | A1 * | 7/2021 | Li | A47C 27/10 |
| 2022/0202198 | A1 * | 6/2022 | Li | A47C 27/087 |
| 2023/0029332 | A1 * | 1/2023 | Xia | A47C 27/081 |
| 2023/0098052 | A1 * | 3/2023 | Shi | A47C 27/082 5/706 |
| 2023/0320491 | A1 * | 10/2023 | Hou | A47C 27/082 |
| 2024/0016303 | A1 * | 1/2024 | Shi | A47C 27/082 |
| 2024/0382012 | A1 * | 11/2024 | Zhang | A47C 27/087 |
| 2025/0107636 | A1 * | 4/2025 | Zhang | A47C 27/087 |
| 2025/0120517 | A1 * | 4/2025 | Zeng | A47C 27/002 |

* cited by examiner

AIR MATTRESS

CROSS REFERENCE TO THE RELATED APPLICATIONS

This application is based upon and claims priority to Chinese Patent Application No. 202322669598.0, filed on Sep. 28, 2023; and Chinese Patent Application No. 202322993048.4, filed on Nov. 6, 2023, the entire contents of which are incorporated herein by reference.

TECHNICAL FIELD

The present disclosure relates to the technical field of inflatable products, and in particular to an air mattress.

BACKGROUND

Air mattresses are popular because they are lightweight and easy to carry and store. Air mattresses can serve as guest beds. Aesthetics and comfort are the key points of air mattress design. The existing air mattress usually includes a top sheet, a bottom sheet, and an enclosing sheet located between the top sheet and the bottom sheet to connect the edges of the top sheet and the bottom sheet. The air mattress is usually high, so after the air mattress is inflated, the enclosing sheet is prone to expand outward, affecting aesthetics and comfort.

To limit the outward expansion of the enclosing sheet, an existing air mattress is provided with four straight rectangular upper diagonal pulling sheets to connect the top sheet and the enclosing sheet and four straight rectangular lower diagonal pulling sheets to connect the bottom sheet and the enclosing sheet. The design solves the outward expansion problem of the enclosing sheet. However, the enclosing sheet is provided with a corner at the turning position between each two adjacent sides of the top sheet and the bottom sheet, and the corner lacks the limit effect of the upper and lower diagonal pulling sheets. As a result, the enclosing sheet can still expand outward too much at the corner, affecting the aesthetics of the air mattress.

SUMMARY

A major objective of the present disclosure is to propose an air mattress. The present disclosure aims to solve the technical problem that the enclosing sheet of the air mattress in the prior art is prone to expand outward too much at a corner position to affect the aesthetics and comfort of the air mattress.

In order to achieve the above objective, the present disclosure proposes an air mattress. The air mattress includes a top sheet, a bottom sheet, and an enclosing sheet, where the top sheet and the bottom sheet are spaced vertically; the enclosing sheet includes an upper edge connected to an edge of the top sheet and a lower edge connected to an edge of the bottom sheet; the top sheet, the bottom sheet, and the enclosing sheet define an inflatable air chamber; the enclosing sheet is provided with a corner at a turning position between each two adjacent sides of the top sheet; the air chamber is provided therein with multiple vertical pulling sheets; and the vertical pulling sheets each include an upper end connected to the top sheet and a lower end connected to the bottom sheet;

the air chamber is further provided therein with multiple upper diagonal pulling sheets and multiple lower diagonal pulling sheets;

the multiple upper diagonal pulling sheets are arranged along an outer circumference of the top sheet; the multiple upper diagonal pulling sheets correspond to multiple sides of the top sheet; the upper diagonal pulling sheets each include an upper edge connected to a lower side of the top sheet and a lower edge connected to an inner side of the enclosing sheet; ends of each of the upper diagonal pulling sheets are provided with upper curved portions; the upper curved portions are located at an inner side of a corresponding corner; and the upper curved portions each include an upper edge connected to the lower side of the top sheet and a lower edge connected to the inner side of the corner; and the multiple lower diagonal pulling sheets are arranged along an outer circumference of the bottom sheet; the multiple lower diagonal pulling sheets correspond to multiple sides of the bottom sheet; the lower diagonal pulling sheets each include a lower edge connected to an upper side of the bottom sheet and an upper edge connected to the inner side of the enclosing sheet; ends of each of the lower diagonal pulling sheets are provided with lower curved portions; the lower curved portions are located at an inner side of a corresponding corner; and the lower curved portions each include a lower edge connected to the upper side of the bottom sheet and an upper edge connected to the inner side of the corner.

The upper curved portions are provided at the ends of each of the upper diagonal pulling sheets, and the lower curved portions are provided at the ends of each of the lower diagonal pulling sheets. The upper curved portions and the lower curved portions are arranged around the corners of the enclosing sheet and connected to the corners. This improves the connection of the enclosing sheet at the corners, further limits the outward expansion of the enclosing sheet at the corners, and effectively reduces the outward expansion at the corners, thereby improving the aesthetics of the air mattress.

Preferably, an upper gap is provided between the ends of each two adjacent upper diagonal pulling sheets; and a lower gap is provided between the ends of each two adjacent lower diagonal pulling sheets.

Preferably, the end of each of the upper diagonal pulling sheets is provided with an upper curved notch; and the end of each of the lower diagonal pulling sheets is provided with a lower curved notch.

Preferably, a connection seam between each of the upper diagonal pulling sheets and the top sheet is defined as a first connection seam, a connection seam between each of the upper diagonal pulling sheets and the enclosing sheet is defined as a second connection seam, a connection seam between each of the lower diagonal pulling sheets and the bottom sheet is defined as a third connection seam, and a connection seam between each of the lower diagonal pulling sheets and the enclosing sheet is defined as a fourth connection seam; and two ends of the first connection seam, two ends of the second connection seam, two ends of the third connection seam, and two ends of the fourth connection seam are all curved.

Preferably, a connection seam between each of the upper diagonal pulling sheets and the top sheet is defined as a first connection seam, a connection seam between each of the upper diagonal pulling sheets and the enclosing sheet is defined as a second connection seam, a connection seam between each of the lower diagonal pulling sheets and the bottom sheet is defined as a third connection seam, and a connection seam between each of the lower diagonal pulling sheets and the enclosing sheet is defined as a fourth connection seam; at least some ends of the first connection seam, the second connection seam, the third connection seam, and the fourth connection seam are drop-shaped ends; and a width of the drop-shaped end is greater than a width of a main body of each of the first connection seam, the second connection seam, the third connection seam, and the fourth connection seam.

The drop-shaped end reduces the stress at the connection position at the end of the connection seam, improves the strength and pull-apart resistance of the end of the connection seam, and reduces the possibility of damage. Therefore, the drop-shaped end can extend the service life of the air mattress.

Preferably, a connection seam between each of the upper diagonal pulling sheets and the top sheet is defined as a first connection seam, a connection seam between each of the upper diagonal pulling sheets and the enclosing sheet is defined as a second connection seam, a connection seam between each of the lower diagonal pulling sheets and the bottom sheet is defined as a third connection seam, and a connection seam between each of the lower diagonal pulling sheets and the enclosing sheet is defined as a fourth connection seam; and the second connection seam and the fourth connection seam are spaced vertically.

Preferably, a distance between the second connection seam and the fourth connection seam is greater than a distance between the second connection seam and the top sheet and a distance between the fourth connection seam and the bottom sheet.

Preferably, a portion of the top sheet located at an outer side of each of the upper diagonal pulling sheets is higher than a portion of the top sheet located at an inner side of each of the upper diagonal pulling sheets; and a portion of the bottom sheet located at an outer side of each of the lower diagonal pulling sheets is lower than a portion of the bottom sheet located at an inner side of each of the lower diagonal pulling sheets.

Preferably, the top sheet and the bottom sheet are quadrilateral; and there are four corners, four upper diagonal pulling sheets, and four lower diagonal pulling sheets.

BRIEF DESCRIPTION OF THE DRAWINGS

To describe the technical solutions in the embodiments of the present disclosure or in the prior art more clearly, the following briefly describes the drawings required for describing the embodiments or the prior art. Apparently, the drawings in the following description show some embodiments of the present disclosure, and those skilled in the art may still derive other drawings from these drawings without creative efforts.

Figure 1:
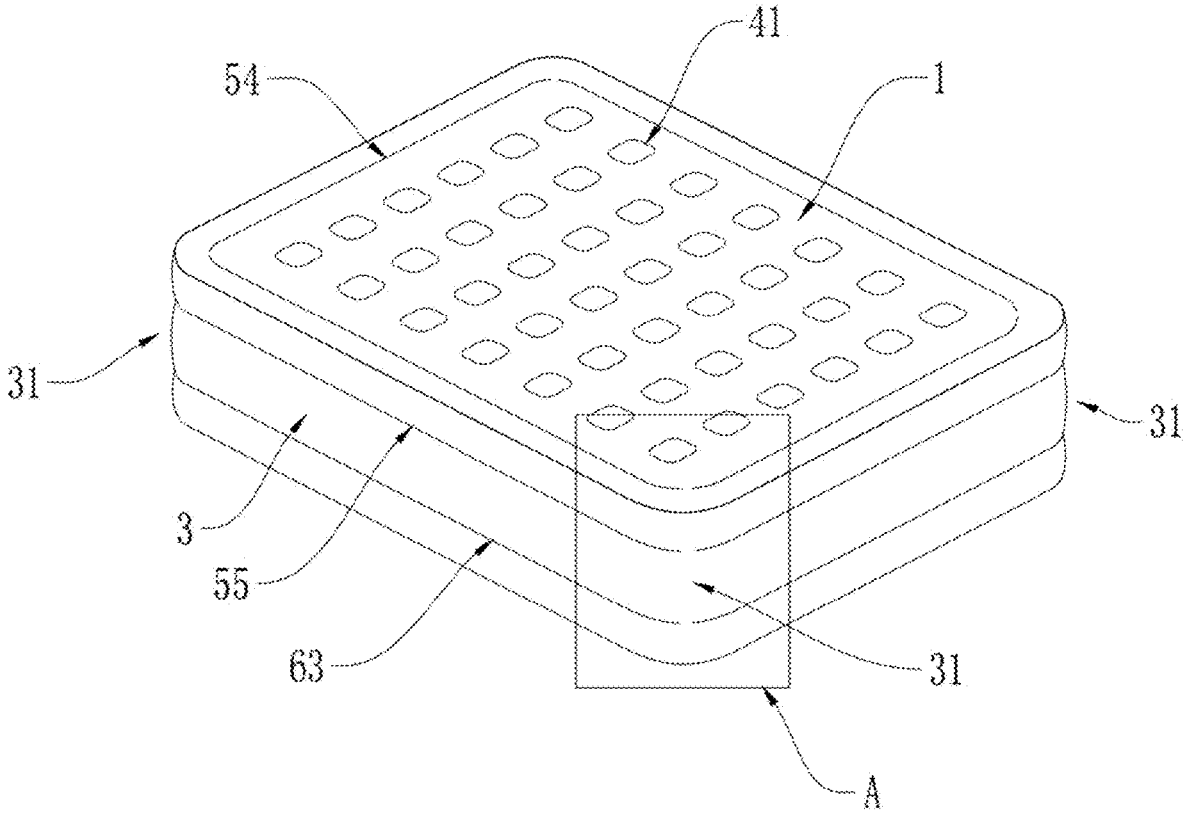
FIG. 1 is a structural diagram of an air mattress according to the present disclosure.

Reference Numerals: 1. top sheet; 2. bottom sheet; 3. enclosing sheet, 31. corner; 4. vertical pulling sheet; 41. fifth connection seam; 5. upper diagonal pulling sheet; 51. upper curved portion; 52. upper gap; 53. upper curved notch; 54. first connection seam; 55. second connection seam; 56. drop-shaped end; 6. lower diagonal pulling sheet; 62. third connection seam; and 63. fourth connection seam.

The implementation of the objective, functional characteristics and advantages of the present disclosure will be further described below with reference to the embodiments and the drawings.

DETAILED DESCRIPTION OF THE EMBODIMENTS

The technical solutions in embodiments of the present disclosure will be described below clearly and completely with reference to the drawings in the embodiments of the present disclosure. Apparently, the described embodiments are merely a part, rather than all of the embodiments of the present disclosure. All other embodiments obtained by those skilled in the art based on the embodiments of the present disclosure without creative efforts shall fall within the protection scope of the present disclosure.

It should be noted that all the directional indications, such as upper, lower, left, right, front, and back, in the embodiments of the present disclosure are merely used to explain a relative position relationship or motion situation of the components in a specific gesture. If the specific gesture changes, the directional indication changes accordingly.

Moreover, the terms such as "first" and "second" described in the embodiments of the present disclosure are used herein only for the purpose of description and are not intended to indicate or imply relative importance, or implicitly indicate the number of the indicated technical features. Therefore, features defined by "first" and "second" may explicitly or implicitly include at least one of the features. Further, the technical solutions of the various embodiments may be combined together on the basis that the combination is implementable by those skilled in the art. In case a combination of the technical solutions is contradictory or infeasible, such a combination is deemed inexistent and not falling within the protection scope of the present disclosure.

As shown in FIGS. 1 to 4, an air mattress includes top sheet 1, bottom sheet 2, and enclosing sheet 3. The top sheet 1 and the bottom sheet 2 are spaced vertically. The enclosing sheet 3 includes an upper edge connected to an edge of the top sheet 1 and a lower edge connected to an edge of the bottom sheet 2. The top sheet 1, the bottom sheet 2, and the enclosing sheet 3 define an inflatable air chamber. The enclosing sheet 3 is provided with corner 31 at a turning position between each two adjacent sides of the top sheet 1. The air chamber is provided therein with multiple vertical pulling sheets 4. The vertical pulling sheets 4 each include an upper end connected to the top sheet 1 and a lower end connected to the bottom sheet 2. The vertical pulling sheets 4 are configured to limit vertical expansion of the top sheet 1 and the bottom sheet 2.

The air chamber is further provided therein with multiple upper diagonal pulling sheets 5 and multiple lower diagonal pulling sheets 6.

Figure 4:
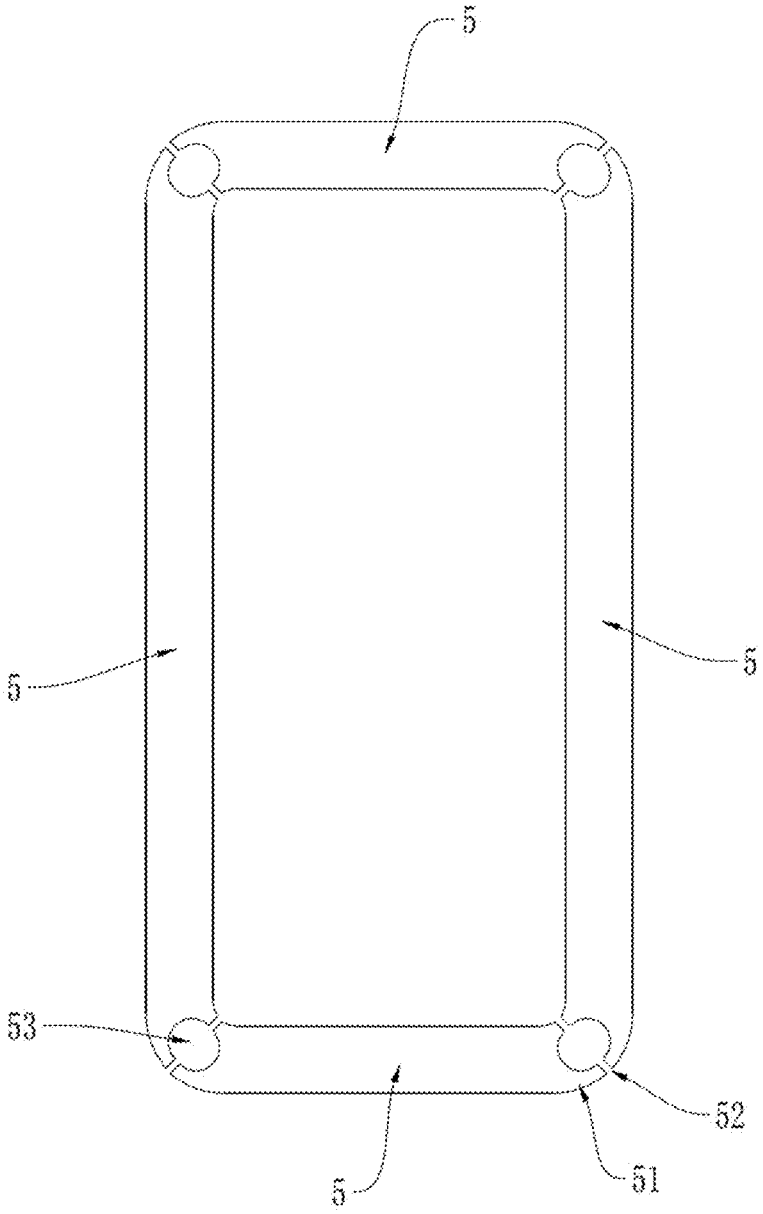
FIG. 4 is a top view of multiple upper diagonal pulling sheets according to the present disclosure.

The multiple upper diagonal pulling sheets 5 are arranged along an outer circumference of the top sheet 1. Referring to FIG. 4, the multiple upper diagonal pulling sheets 5 correspond to multiple sides of the top sheet 1. The upper diagonal pulling sheets 5 each include an upper edge connected to a lower side of the top sheet 1 and a lower edge connected to an inner side of the enclosing sheet. Ends of each of the upper diagonal pulling sheets 5 are provided with upper curved portions 51. The upper curved portions 51 are located at an inner side of corresponding corner 31. The upper curved portions 51 each include an upper edge connected to the lower side of the top sheet 1 and a lower edge connected to the inner side of the corner 31.

The multiple lower diagonal pulling sheets 6 are arranged along an outer circumference of the bottom sheet 2. The multiple lower diagonal pulling sheets 6 correspond to multiple sides of the bottom sheet 2. The lower diagonal pulling sheets 6 each include a lower edge connected to an upper side of the bottom sheet 2 and an upper edge connected to the inner side of the enclosing sheet. Ends of each of the lower diagonal pulling sheets 6 are provided with lower curved portions. The lower curved portions are located at an inner side of corresponding corner 31. The lower curved portions each include a lower edge connected to the upper side of the bottom sheet 2 and an upper edge connected to the inner side of the corner 31.

The upper curved portions 51 are provided at the ends of each of the upper diagonal pulling sheets 5, and the lower curved portions are provided at the ends of each of the lower diagonal pulling sheets 6. The upper curved portions 51 and the lower curved portions are arranged around the corners 31 of the enclosing sheet 3 and connected to the corners 31. This improves the connection of the enclosing sheet 3 at the corners 31, further limits the outward expansion of the enclosing sheet at the corners 31, and effectively reduces the outward expansion at the corners 31, thereby improving the aesthetics of the air mattress.

In some specific embodiments, upper gap 52 is provided between the ends of each two adjacent upper diagonal pulling sheets 5, and a lower gap is provided between the ends of each two adjacent lower diagonal pulling sheets 6. The design avoids the assembly of each two adjacent upper diagonal pulling sheets 5 and each two adjacent lower diagonal pulling sheets 6 being affected by excessive size. The upper gap 52 and the lower gap further help air circulation, allowing air to enter a position between each of the upper diagonal pulling sheets 5 and the top sheet 1 as well as the enclosing sheet 3, as well as a position between each of the lower diagonal pulling sheets 6 and the bottom sheet 2 as well as the enclosing sheet 3.

Another drawback of the existing air mattress is the concentration of stress at two ends of the straight rectangular upper diagonal pulling sheet 5 and at two ends of the lower diagonal pulling sheet 6. As a result, the connection between each end of the upper diagonal pulling sheet 5 and the top sheet 1 as well as the enclosing sheet 3 and the connection between each end of each of the lower diagonal pulling sheets 6 and the bottom sheet 2 as well as the enclosing sheet 3 are easily damaged, affecting the service life of the air mattress.

In some specific embodiments, the end of each of the upper diagonal pulling sheets 5 is provided with upper curved notch 53, and the end of each of the lower diagonal pulling sheets 6 is provided with a lower curved notch. Compared to the straight end in the prior art, the curved notch design in the present disclosure has the following effects. When the upper diagonal pulling sheet 5 is tensioned by the top sheet 1 and the enclosing sheet 3, the upper curved notch 53 disperses a stress at a connection seam between each of the upper diagonal pulling sheets 5 and the top sheet 1 and a stress at a connection seam between each of the upper diagonal pulling sheets 5 and the enclosing sheet 3. When the lower diagonal pulling sheet 6 is tensioned by the bottom sheet 2 and the enclosing sheet 3, the lower curved notch disperses a stress at a connection seam between each of the lower diagonal pulling sheets 6 and the top sheet 1 and a stress at a connection seam between each of the lower diagonal pulling sheets 6 and the enclosing sheet 3. The design improves the load bearing capacity of the connection seam and the pull-apart resistance of the end of the connection seam, thereby extending the service life of the air mattress. Radii of the upper curved notch 53 and a radius of the lower curved notch are determined based on widths and effectiveness of the upper diagonal pulling sheet 5 and the lower diagonal pulling sheet 6, respectively.

The connection seam between each of the upper diagonal pulling sheets 5 and the top sheet 1 is defined as first connection seam 54, the connection seam between each of the upper diagonal pulling sheets 5 and the enclosing sheet 3 is defined as second connection seam 55, the connection seam between each of the lower diagonal pulling sheets 6 and the bottom sheet 2 is defined as third connection seam 62, and the connection seam between each of the lower diagonal pulling sheets 6 and the enclosing sheet 3 is defined as fourth connection seam 63.

Figure 2:
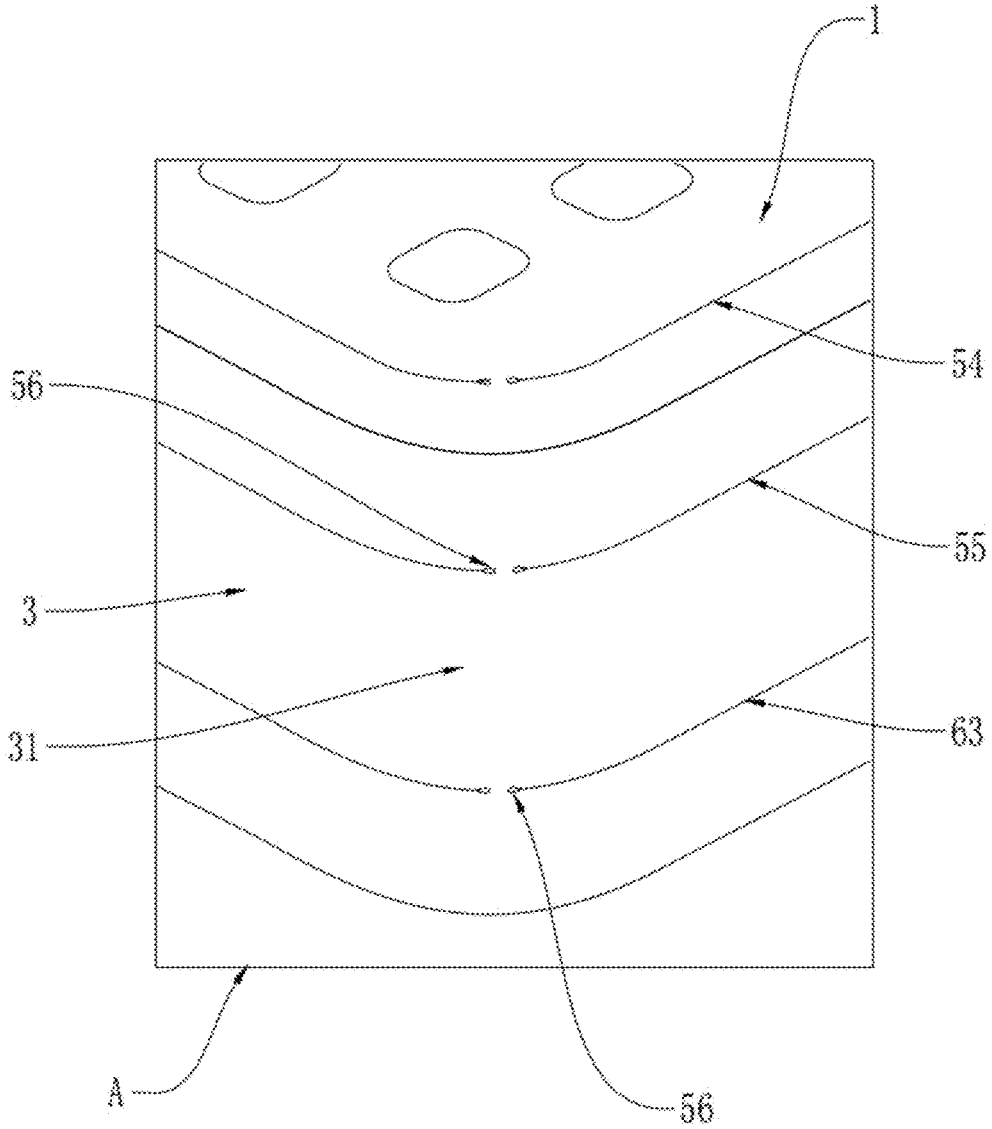
FIG. 2 is an enlarged view of A shown in FIG. 1.
Figure 3:
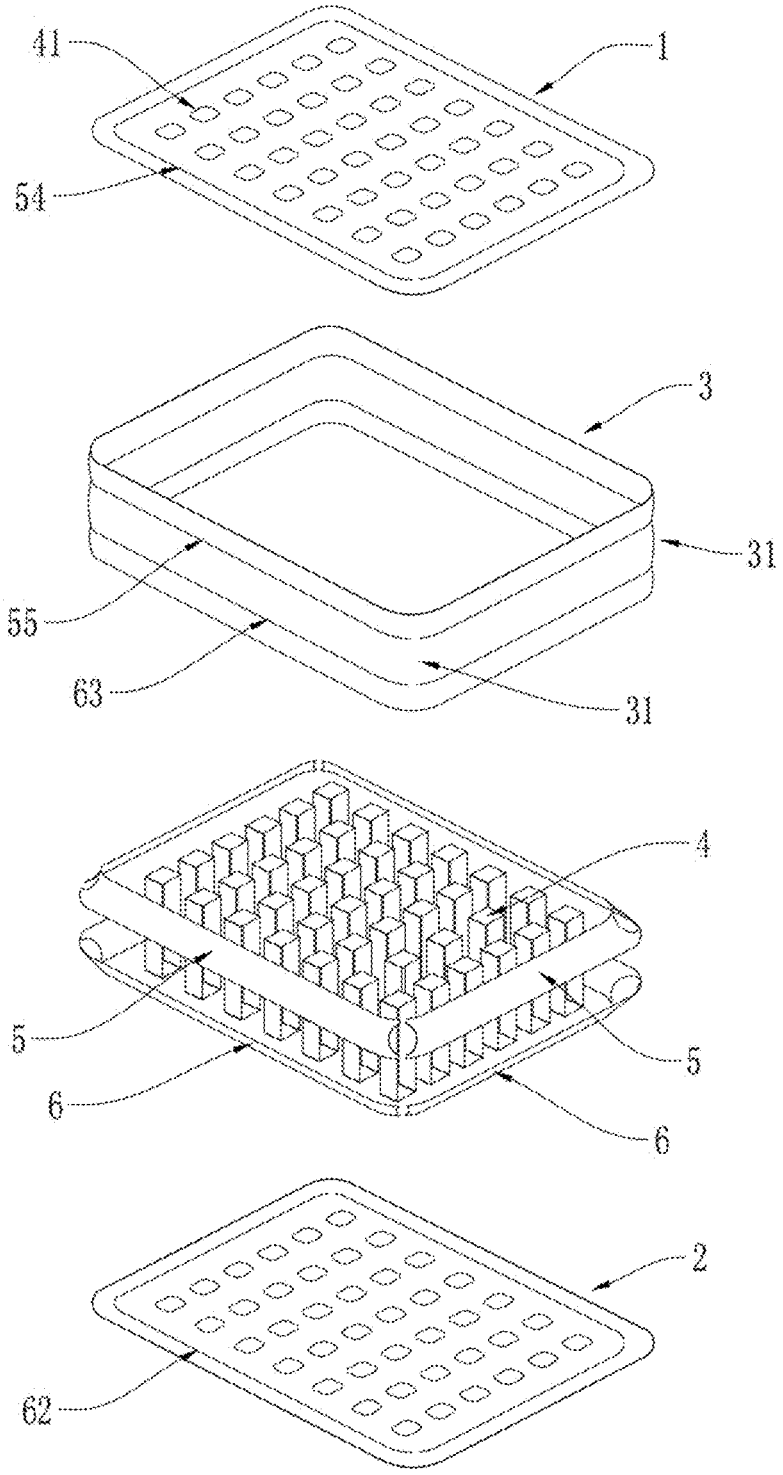
FIG. 3 is an exploded view of the air mattress according to the present disclosure.

In some specific embodiments, referring to FIG. 2, at least some ends of the first connection seam 54, the second connection seam 55, the third connection seam 62, and the fourth connection seam 63 are drop-shaped ends 56. A width of the drop-shaped end 56 is greater than a width of a main body of each of the first connection seam 54, the second connection seam 55, the third connection seam 62, and the fourth connection seam 63.

In the solution of the present disclosure, the drop-shaped end 56 forms an curved transition to increase the size and connection strength of the end of the connection seam, thereby reducing the stress at the end of the connection seam, improving the pull-apart resistance of the end of the connection seam, and reducing the possibility of damage. Therefore, the drop-shaped end can withstand a significant load, thereby extending the service life of the air mattress. The drop-shaped end can be formed by welding through a drop-shaped welding mold.

Comparative tests were conducted between existing air mattresses and the air mattress of the present disclosure.

Test Method. Re-inflation tests, rolling tests, and durability tests were conducted on the air mattress in sequence within a testing cycle. The number of testing cycles conducted to pull apart the connection seam between the diagonal pulling sheet and the enclosing sheet of the air mattress was recorded. A larger number of testing cycles would indicate that a greater load bearing capacity and pull-apart resistance of the air mattress.

Test Procedure for Re-inflation Test: The air mattress was inflated to 3,800 Pa, and the air pressure was held for 30 s. Then the air mattress was deflated to 2,500 Pa, and re-inflated to 3,800 Pa. The inflation and deflation were cycled 500 times.

Test Procedure for Rolling Test: The air mattress was inflated to 3,800 Pa. Then a load of 226 kg was put on the air mattress, and rolled back and forth 1,000 times on the air mattress.

Test Procedure for Durability Test: The air mattress was inflated to 3,800 Pa. Then the air mattress was pressed down with a force of 100 Kg and pulled up. The press-down and pull-up were cycled 10,000 times.

Comparative Example 1

Three existing air mattresses were tested, and the number of testing cycles conducted to pull apart the connection seam between the diagonal pulling sheet and the enclosing sheet of each of the three air mattresses was recorded.

Embodiment 1

In Embodiment 1, the upper diagonal pulling sheet 5 of the air mattress is provided with a straight end, and the lower diagonal pulling sheet 6 is provided with a straight end. None of the first connection seam 54, the second connection seam 55, the third connection seam 62, and the fourth connection seam 63 forms the drop-shaped end 56. The testing method of this embodiment is the same as that of Comparative Example 1, and the number of testing cycles conducted to pull apart the connection seam between the diagonal pulling sheet and the enclosing sheet of each of the three air mattresses was recorded.

Embodiment 2

The structure of the air mattress in Embodiment 2 is the same as that in Embodiment 1, except that the end of each of the upper diagonal pulling sheets 5 is provided with the upper curved notch 53, and the end of each of the lower diagonal pulling sheets 6 is provided with the lower curved notch. The testing method of this embodiment is the same as that of Comparative Example 1, and the number of testing cycles conducted to pull apart the connection seam between the diagonal pulling sheet and the enclosing sheet of each of the three air mattresses was recorded.

Embodiment 3

The structure of the air mattress in Embodiment 3 is the same as that in Embodiment 1, except that the first connection seam 54, the second connection seam 55, the third connection seam 62, and the fourth connection seam 63 are all provided with the drop-shaped ends 56. The testing method of this embodiment is the same as that of Comparative Example 1, and the number of testing cycles conducted to pull apart the connection seam between the diagonal pulling sheet and the enclosing sheet of each of the three air mattresses was recorded.

Embodiment 4

The structure of the air mattress in Embodiment 3 is the same as that in Embodiment 1, except for the following differences. The end of each of the upper diagonal pulling sheets 5 is provided with the upper curved notch 53, and the end of each of the lower diagonal pulling sheets 6 is provided with the lower curved notch. The first connection seam 54, the second connection seam 55, the third connection seam 62, and the fourth connection seam 63 are all provided with the drop-shaped ends 56. The testing method of this embodiment is the same as that of Comparative Example 1, and the number of testing cycles conducted to pull apart the connection seam between the diagonal pulling sheet and the enclosing sheet of each of the three air mattresses was recorded.

The test data for Embodiment 1, Embodiment 1, Embodiment 2, Embodiment 3, and Embodiment 4 are shown in Table 1.

TABLE 1

| | Number of testing cycles conducted to cause pull-apart | | |
|---|---|---|---|
| | Air mattress 1 | Air mattress 2 | Air mattress 3 |
| Comparative Example 1 | 3 | 3 | 3 |
| Embodiment 1 | 4 | 3 | 4 |
| Embodiment 2 | 6 | 6 | 6 |
| Embodiment 3 | 5 | 5 | 6 |
| Embodiment 4 | 10 | 9 | 9 |

According to Table 1, when the end of each of the upper diagonal pulling sheets 5 is provided with the upper curved notch 53, the end of each of the lower diagonal pulling sheets 6 is provided with the lower curved notch, or the connection seam is provided with the drop-shaped end 56, the load bearing capacity and pull-apart resistance of the air mattress are improved. When the upper curved notch 53, the lower curved notch, and the drop-shaped end 56 are arranged simultaneously, the load bearing capacity of the air mattress is further improved.

In some specific embodiments, the two ends of the first connection seam 54, the two ends of the second connection seam 55, the two ends of the third connection seam 62, and the two ends of the fourth connection seam 63 are all curved, adapting to the shape of the corner 31.

In some specific embodiments, the second connection seam 55 and the fourth connection seam 63 are spaced vertically.

Further, a distance between the second connection seam 55 and the fourth connection seam 63 is greater than a distance between the second connection seam 55 and the top sheet 1 and a distance between the fourth connection seam 63 and the bottom sheet 2.

In some specific embodiments, a portion of the top sheet 1 located at an outer side of each of the upper diagonal pulling sheets 5 is higher than a portion of the top sheet 1 located at an inner side of each of the upper diagonal pulling sheets 5, and a portion of the bottom sheet 2 located at an outer side of each of the lower diagonal pulling sheets 6 is lower than a portion of the bottom sheet 2 located at an inner side of each of the lower diagonal pulling sheets 6.

Another drawback of the existing air mattresses is that the top surface of the air mattress is roughly horizontal, making it easy for the user to slide off the edge of the air mattress. In addition, the bottom surface of the air mattress is also roughly horizontal and the support point at the bottom of the air mattress is located at the center of the air mattress when the user lies on the air mattress, making it easy for the air mattress to overturn.

In the solution of the present disclosure, the top surface of the air mattress is lower inside and higher outside, making it difficult for the user to slide off the edge of the air mattress. In addition, the bottom surface of the air mattress is also lower inside and higher outside and the support point of the air mattress is located outside the bottom surface, ensuring that the air mattress is not easily overturned.

In some specific embodiments, the top sheet 1 and the bottom sheet 2 are quadrilateral, and there are four corners 31, four upper diagonal pulling sheets 5, and four lower diagonal pulling sheets 6.

In some specific embodiments, the vertical pulling sheet 4 can be a circular-hole pulling sheet with two side sheets for force bearing. The vertical pulling sheet 4 can also be an existing straight sheet, such as an I-shaped sheet or a Y-shaped sheet that extends along a length or width of the air mattress and includes two ends connected to the top sheet 1 and the bottom sheet 2, respectively. In this case, multiple straight sheets are arranged at intervals.

The above described are merely preferred embodiments of the present disclosure, which are not intended to limit the scope of the patent of the present disclosure. Any equivalent structure transformation made based on the description and drawings of the present disclosure, or direct or indirect application thereof in other related technical fields, should fall within the protection scope of the patent of the present disclosure.

What is claimed is:

1. An air mattress, comprising a top sheet, a bottom sheet, and an enclosing sheet, wherein the top sheet and the bottom sheet are spaced vertically; the enclosing sheet comprises an upper edge connected to an edge of the top sheet and a lower edge connected to an edge of the bottom sheet; the top sheet, the bottom sheet, and the enclosing sheet define an inflatable air chamber; the enclosing sheet is provided with a corner at a turning position between each two adjacent sides of the top sheet; the air chamber is provided therein with a plurality of vertical pulling sheets; and the plurality of vertical pulling sheets each comprise an upper end connected to the top sheet and a lower end connected to the bottom sheet;

the air chamber is further provided therein with a plurality of upper diagonal pulling sheets and a plurality of lower diagonal pulling sheets;

the plurality of upper diagonal pulling sheets are arranged along an outer circumference of the top sheet; the plurality of upper diagonal pulling sheets correspond to a plurality of sides of the top sheet; the plurality of upper diagonal pulling sheets each comprise an upper edge connected to a lower side of the top sheet and a lower edge connected to an inner side of the enclosing sheet; ends of each of the plurality of upper diagonal pulling sheets are provided with upper curved portions; the upper curved portions are located at an inner side of a corresponding corner; and the upper curved portions each comprise an upper edge connected to the lower side of the top sheet and a lower edge connected to the inner side of the corner;

the end of each of the plurality of upper diagonal pulling sheets is provided with an upper curved notch, forming four pairs of upper curved notches, wherein the two notches in each pair of the four pairs of upper curved notches face each other and form a circular space therebetween; and the plurality of lower diagonal pulling sheets are arranged along an outer circumference of the bottom sheet; the plurality of lower diagonal pulling sheets correspond to a plurality of sides of the bottom sheet; the plurality of lower diagonal pulling sheets each comprise a lower edge connected to an upper side of the bottom sheet and an upper edge connected to the inner side of the enclosing sheet; ends of each of the plurality of lower diagonal pulling sheets are provided with lower curved portions; the lower curved portions are located at an inner side of a corresponding corner; and the lower curved portions each comprise a lower edge connected to the upper side of the bottom sheet and an upper edge connected to the inner side of the corner.

2. The air mattress according to claim 1, wherein an upper gap is provided between the ends of each two adjacent upper diagonal pulling sheets; and a lower gap is provided between the ends of each two adjacent lower diagonal pulling sheets.

3. The air mattress according to claim 1, wherein the end of each of the plurality of lower diagonal pulling sheets is provided with a lower curved notch.

4. The air mattress according to claim 1, wherein a connection seam between each of the plurality of upper diagonal pulling sheets and the top sheet is defined as a first connection seam, a connection seam between each of the plurality of upper diagonal pulling sheets and the enclosing sheet is defined as a second connection seam, a connection seam between each of the plurality of lower diagonal pulling sheets and the bottom sheet is defined as a third connection seam, and a connection seam between each of the plurality of lower diagonal pulling sheets and the enclosing sheet is defined as a fourth connection seam; and two ends of the first connection seam, two ends of the second connection seam, two ends of the third connection seam, and two ends of the fourth connection seam are all curved.

5. The air mattress according to claim 1, wherein a connection seam between each of the plurality of upper diagonal pulling sheets and the top sheet is defined as a first connection seam, a connection seam between each of the plurality of upper diagonal pulling sheets and the enclosing sheet is defined as a second connection seam, a connection seam between each of the plurality of lower diagonal pulling sheets and the bottom sheet is defined as a third connection seam, and a connection seam between each of the plurality of lower diagonal pulling sheets and the enclosing sheet is defined as a fourth connection seam;

at least some ends of the first connection seam, the second connection seam, the third connection seam, and the fourth connection seam are drop-shaped ends; and a width of the drop-shaped end is greater than a width of a main body of each of the first connection seam, the second connection seam, the third connection seam, and the fourth connection seam.

6. The air mattress according to claim 1, wherein a connection seam between each of the plurality of upper diagonal pulling sheets and the top sheet is defined as a first connection seam, a connection seam between each of the plurality of upper diagonal pulling sheets and the enclosing sheet is defined as a second connection seam, a connection seam between each of the plurality of lower diagonal pulling sheets and the bottom sheet is defined as a third connection seam, and a connection seam between each of the plurality of lower diagonal pulling sheets and the enclosing sheet is defined as a fourth connection seam; and the second connection seam and the fourth connection seam are spaced vertically.

7. The air mattress according to claim 6, wherein a distance between the second connection seam and the fourth connection seam is greater than a distance between the second connection seam and the top sheet and a distance between the fourth connection seam and the bottom sheet.

8. The air mattress according to claim 1, wherein a portion of the top sheet located at an outer side of each of the plurality of upper diagonal pulling sheets is higher than a portion of the top sheet located at an inner side of each of the plurality of upper diagonal pulling sheets; and a portion of the bottom sheet located at an outer side of each of the plurality of lower diagonal pulling sheets is lower than a portion of the bottom sheet located at an inner side of each of the plurality of lower diagonal pulling sheets.

9. The air mattress according to claim 1, wherein the top sheet and the bottom sheet are quadrilateral; and there are four corners, four upper diagonal pulling sheets, and four lower diagonal pulling sheets.

* * * * *